US005341899A

United States Patent [19]

Casamento

[11] Patent Number: 5,341,899

[45] Date of Patent: Aug. 30, 1994

[54] ANTI-SKID AND LEVELING DEVICE FOR LADDERS

[76] Inventor: Michael J. Casamento, 202 Maple St., W. Hempstead, N.Y. 11552

[21] Appl. No.: 190,904

[22] Filed: Feb. 3, 1994

[51] Int. Cl.[5] ..... E06C 1/16

[52] U.S. Cl. ..... 182/205; 182/107; 182/172

[58] Field of Search ..... 182/107, 200–205, 182/172, 108–111

[56] References Cited

U.S. PATENT DOCUMENTS

| | | | |
|---|---|---|---|
| 1,329,740 | 2/1920 | Barron | 182/205 |
| 4,147,231 | 4/1979 | Chantler et al. | 182/172 |
| 5,027,923 | 7/1991 | Derome | 182/201 |

*Primary Examiner*—Alvin C. Chin-Shue

[57] ABSTRACT

An anti-skid and leveling device for ladders is provided, containing a pair of devices, each consisting of a guide rail along which an upper carriage and a lower carriage slide independently. The upper carriage provides a mounting platform onto which a brace is rotatably mounted. When pivoted to a specified angle, and lowered so as to contact the ground, the brace will prevent the ladder from skidding in a direction away from the object on which the ladder is resting. A self locking mechanism employing a series of detents is used to secure the upper carriage in a stationary position. The lower carriage provides a mounting platform onto which an outrigger type foot is mounted. The design of the foot provides the ladder with greater lateral stability. The sliding motion of the lower carriage provides height adjustment for the foot, allowing the ladder to be leveled on uneven terrain. Once adjusted, a self locking mechanism employing a series of detents is used to secure the lower carriage in a stationary position. Each foot contains a large round footpad that swivels 360 degrees. An incline indicator is attached to the guide rail to assist in setting the ladder at the proper incline angle.

15 Claims, 5 Drawing Sheets

ANTI-SKID AND LEVELING DEVICE FOR LADDERS

BACKGROUND—FIELD OF INVENTION

This Invention relates to a ladder safety device. More specifically, such devices used to prevent a ladder from skidding in a direction away from the object on which it is resting. It also relates to devices which enable the ladder to be leveled on uneven surfaces.

BACKGROUND—DESCRIPTION OF PRIOR ART

The most widely used ladder safety devices are stabilizers, and levelers. Stabilizers consist of a pair of long tubular legs, one for each side of the ladder. They are attached to the ladder at a point near the top, and hinged so as to pivot outward and towards the object against which ladder is resting. When not in use they can be folded against the rails of the ladder. This system although very secure once deployed, can only be used if there is a large clear area surrounding the ladder. It is also very expensive. The cost can often be close to or even exceed the cost of the ladder itself. In addition, the stabilizer does not provide any means by which to level the ladder on uneven terrain.

To level the ladder, a separate device must be purchased by the consumer. This device is often referred to as a ladder leveler. The ladder leveler usually consists of a pair of telescoping rods, one for each side rail of the ladder and are attached to the ladder at a point near its base. At the end of each rod is attached some type of foot which is used to provide grip. The rods can be extended downward independently of one another, allowing the user to compensate for uneven terrain.

A similar leveling device has been proposed in U.S. Pat. No. 4,995,474 (1991) to Gauthier. The device comprises a ladder of at least two legs with leveling capabilities. The method of adjustment is by means of a threaded rod running in a longitudinal throughbore in the ladder's leg. In order to make adjustments to the leg height of the ladder, the user is required to manually spin the device. Since the device is an integral part of the ladder's leg, the user must purchase the entire ladder to posses the benefits of the leveling system. In addition, the device is constructed primarily of steel which would add considerable weight to the ladder. Although relatively inexpensive when compared to the stabilizers, the levelers do not provide protection should the ladder's feet loose traction with the surface and begin to slide in a direction away from the object on which the ladder is resting. Furthermore, the levelers must be adjusted with one hand while holding the ladder in a vertical position with the other hand. This can be difficult and even dangerous in windy conditions. Current leveling devices are aligned longitudinally with the side rails of the ladder, and therefor do not provide any increase in lateral stability.

All of the above mentioned devices do not provide the user with an accurate means of setting the ladder at the proper incline angle. The proper incline angle is often the most important safe guard the user should observe, since the ladder's resistance to skidding is greatly influenced by the angle at which it is set in relation to the surface. As an aid to the user, most ladder manufacturers place a sticker on the side rail of the ladder illustrating a vertical line. When the line is perpendicular to the surface the ladder is set at the proper incline angle. This method is not at all accurate since it relies on the user to approximate when the line is perpendicular to the surface.

OBJECTS AND ADVANTAGES

Accordingly, several objects of the invention are as follows:

1. To provide a device which will enable a ladder to resist skidding away from the object on which the ladder is resting.
2. To provide a device which will enable the ladder to be leveled on uneven terrain.
3. To provide a device which will increase the lateral stability of the ladder.
4. To provide a device which will allow the user to accurately determine the optimum incline angle of the ladder.

In keeping with these objects and with others that will follow, one feature of the invention briefly stated, is an anti-skid and leveling device for ladders, consisting of a pair of devices each including a guide rail, an upper carriage which travels along the guide rail, a lower carriage which travels along the guide rail, two end caps attached to the guide rail, an incline indicator attached to the guide rail, a brace detention element attached to the guide rail, a brace latch attached to the guide rail, a brace stay mount attached to the upper carriage, a brace stay attached to the brace stay mount, a flanged cylindrical element attached to the upper carriage, a brace attached to the upper carriage, a friction element attached to the brace, a foot detention element attached to the guide rail, a foot mount attached to the lower carriage, a foot attached to the foot mount, a foot stay attached to the foot, a mounting post attached to the foot, a footpad attached to the mounting post, and a friction element attached to the footpad.

Basing the construction of the invention on the guide rail, to which all other elements are affixed, results in a compact, narrow structure only slightly wider than the side rails of the ladder itself, thus keeping the ladder slim and easy to handle. The invention is permanently attached to the side rails of the ladder, thereby allowing for ease of portability. Since the guide rail's structural rigidity is enhanced by the side rails of the ladder, it can be made of a lightweight material such as plastic.

The sliding upper and lower carriages provide a sturdy yet simple means by which to adjust the inventions features.

The incline indicator provides the user with a quick, accurate means of attaining the proper incline angle of the ladder with respect to the surface.

The brace is hinged at the top and can be folded into a position parallel to the guide rail for efficient storage when not in use. The height adjustment mechanism for the brace is self locking which eliminates any possibility of human error. In addition, the self locking mechanism makes adjusting the brace quick and easy. Since the brace always remains parallel to the vertical plane of the ladder's side rail, it can be deployed even in confined areas.

The foot is designed to act as an outrigger which adds to the lateral stability of the ladder, and is adjustable in height to enable the ladder to be leveled on uneven terrain. The height adjustment mechanism for the foot is self locking, which eliminates any possibility of human error. In addition, the self locking mechanism makes adjusting the invention's foot quick and easy.

The height of the invention's foot can be adjusted with pressure applied by the user's foot, enabling the user to keep both hands on the ladder. This is especially useful in conditions of high wind.

The footpad is designed to swivel in all directions, enabling it to adjust to the slope of the terrain. In addition, the footpad is round in shape and large in diameter. This helps to prevent the footpad from sinking into soft terrain, as well as provide exceptional grip on harder surfaces.

The invention can be made of lightweight materials such as plastic and aluminum, thereby contributing little additional weight to the ladder. It is self contained requiring no other parts or assembly once installed. Furthermore, the invention effectively combines the features of stability and levelability into a single device.

DESCRIPTION OF THE DRAWING FIGURES

FIG. 1—a perspective view of the guide rail assembly.

FIG. 1*a*—a cross section view of the upper carriage and guide rail.

FIG. 1*b*—a cross section view of the lower carriage and guide rail.

FIG. 2—a perspective view showing details of the upper carriage and brace assembly.

FIG. 3—a perspective view showing details of the lower carriage and foot assembly.

FIG. 4—a side view showing the brace in its stored and deployed position.

FIG. 5—a frontal view of the invention showing attachment to the side rails of a ladder.

LIST OF REFERENCE NUMERALS USED IN THE DRAWINGS

12—a guide rail of the anti-skid and leveling device for ladders 10
14—an upper carriage
16—a lower carriage
18*a*—an upper end cap
18*b*—a lower end cap
20—a tubular level vial
22—a vial mount
24—a flanged cylindrical element
26—a brace
28—a brace latch
30—a brace detention element
32—a brace stay
34—a brace stay mount
36—a hinge pin of the brace stay 32
38—an external retaining ring of the hinge pin 36
40—a friction element of the brace 26
42—a foot
44—a foot detention element
46—a foot stay
48—a foot mount
50—a hinge pin of the foot mount 48
52—an external retaining ring of the hinge pin 50
54—a footpad
56—a friction element of the footpad 54
58—a ball end
60—a ball end retainer
62—a mounting post
66—a spring
68—face of the guide rail 12
70—rear side of the guide rail 12
72—front side of the guide rail 12
74—front side upper groove of the guide rail 12
76—rear side upper groove of the guide rail 12
78—front side lower groove of the guide rail 12
80—rear side lower groove of the guide rail 12
82—brace detention element recess of the guide rail 12
84—foot detention element recess of the guide rail 12
86—incline indicator recess of the guide rail 12
88—upper flange of the guide rail 12
90—lower flange of the guide rail 12
92—rear side surface of the upper carriage 14
94—face of the upper carriage 14
95—cut-out of the upper carriage 14
96—guide flange of the upper carriage 14
98—other guide flange of the upper carriage 14
100—rear side surface of the lower carriage 16
102—face of the lower carriage 16
103—cut-out of the lower carriage 16
104—guide flange of the lower carriage 16
106—other guide flange of the lower carriage 16
108—sliding surface of the brace detention element 30
110—resting surface of the brace detention element 30
112—sliding surface of the foot detention element 44
114—resting surface of the foot detention element 44
116—face of the brace 26
118—front side of the brace 26
120—rear side of the brace 26
122—mounting post receptacle of the foot 42
124—spring receptacle of the foot 42
126—notch in the foot 42
127—concave recess in the footpad 54
128—flat surface of the ball end 58
130—internally tapped hole of the ball end 58
132—externally threaded area of the mounting post 62
134—flange of the mounting post 62
136—recess in the endcap 18*a*
138—recess in the endcap 18*b*
140—a plurality of screws
142—pivot point of the foot 42
144—pivot point of the brace 26
146—incline indicator assembly
148—left guide rail assembly
150—right guide rail assembly
152—left side rail of ladder
154—right side rail of ladder

DETAILED DESCRIPTION OF THE PREFERRED EMBODIMENT

Figure 1:
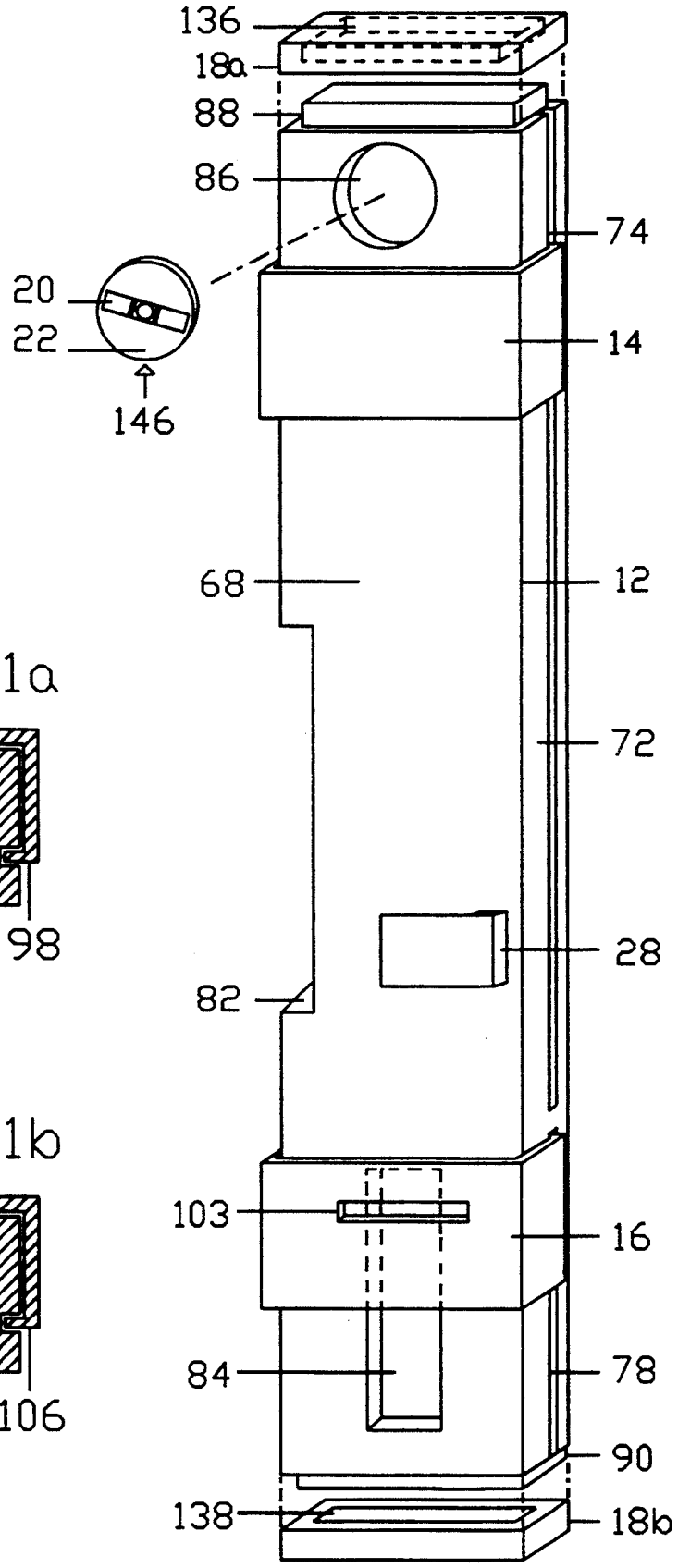

Referring to FIGS. 1–5, the invention consists of a pair of devices each including a guide rail 12, an upper carriage 14, a lower carriage 16, an upper and lower end cap 18*a* and 18*b* respectively, an incline indicator assembly 146, a flanged cylindrical element 24, a brace 26, a brace latch 28, a brace detention element 30, a brace stay 32, a brace stay mount 34, a brace stay hinge pin 36, two external retaining rings 38, and 52, a brace friction element 40, a foot 42, a foot detention element 44, a foot stay 46, a foot mount 48, a foot mount hinge pin 50 a footpad 54, a footpad friction element 56, a ball end 58, a ball end retainer 60, a mounting post 62, and a spring 66.

The guide rail 12 includes a face 68, a rear side 70, a front side 72, a front side upper groove 74, a rear side upper groove 76, a front side lower groove 78, a rear side lower groove 80, a brace detention element recess 82, a foot detention element recess 84, an incline indicator recess 86, an upper flange 88, and a lower flange 90; (FIGS. 1, 1*a*, 1*b*, 2, 3).

Figure 1A:
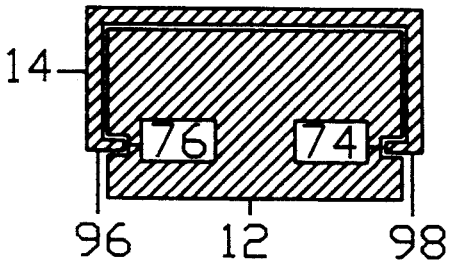
Figure 2:
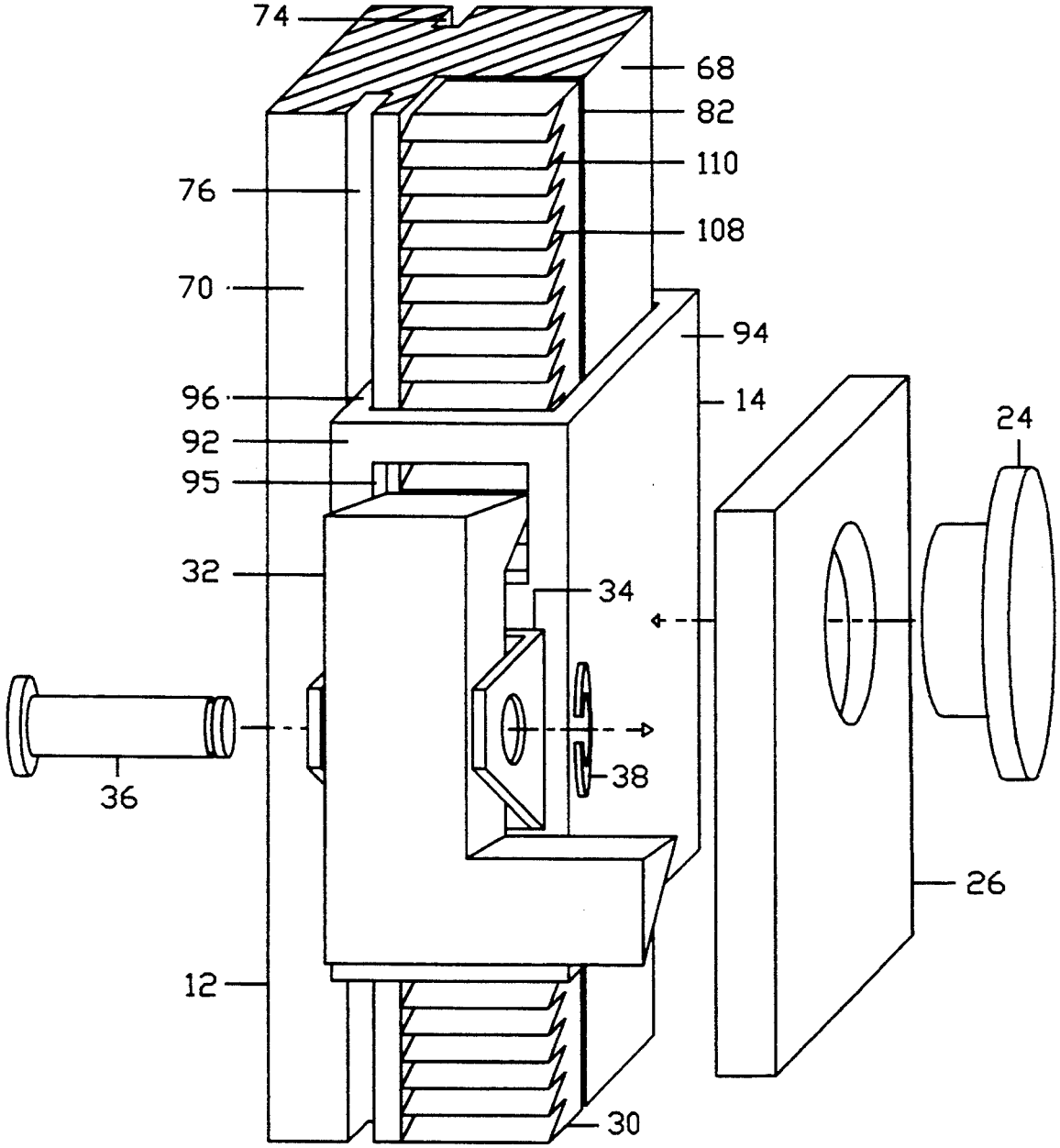

The upper carriage 14 includes a rear side surface 92, a face 94, a cut-out 95, and a pair of guide flanges 96 and 98 respectively; (FIGS. 1*a*, 2).

The upper carriage 14 is installed over the guide rail 12 by engaging the guide flanges 96 and 98 respectively, with the front and rear side upper grooves 74 and 76 respectively, of the guide rail 12; (FIGS. 1*a*).

Figure 1B:
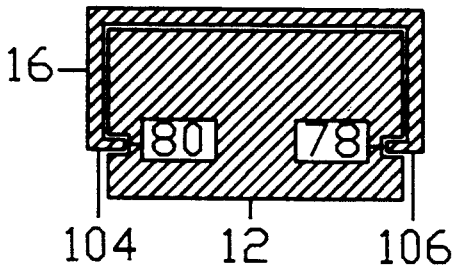
Figure 3:
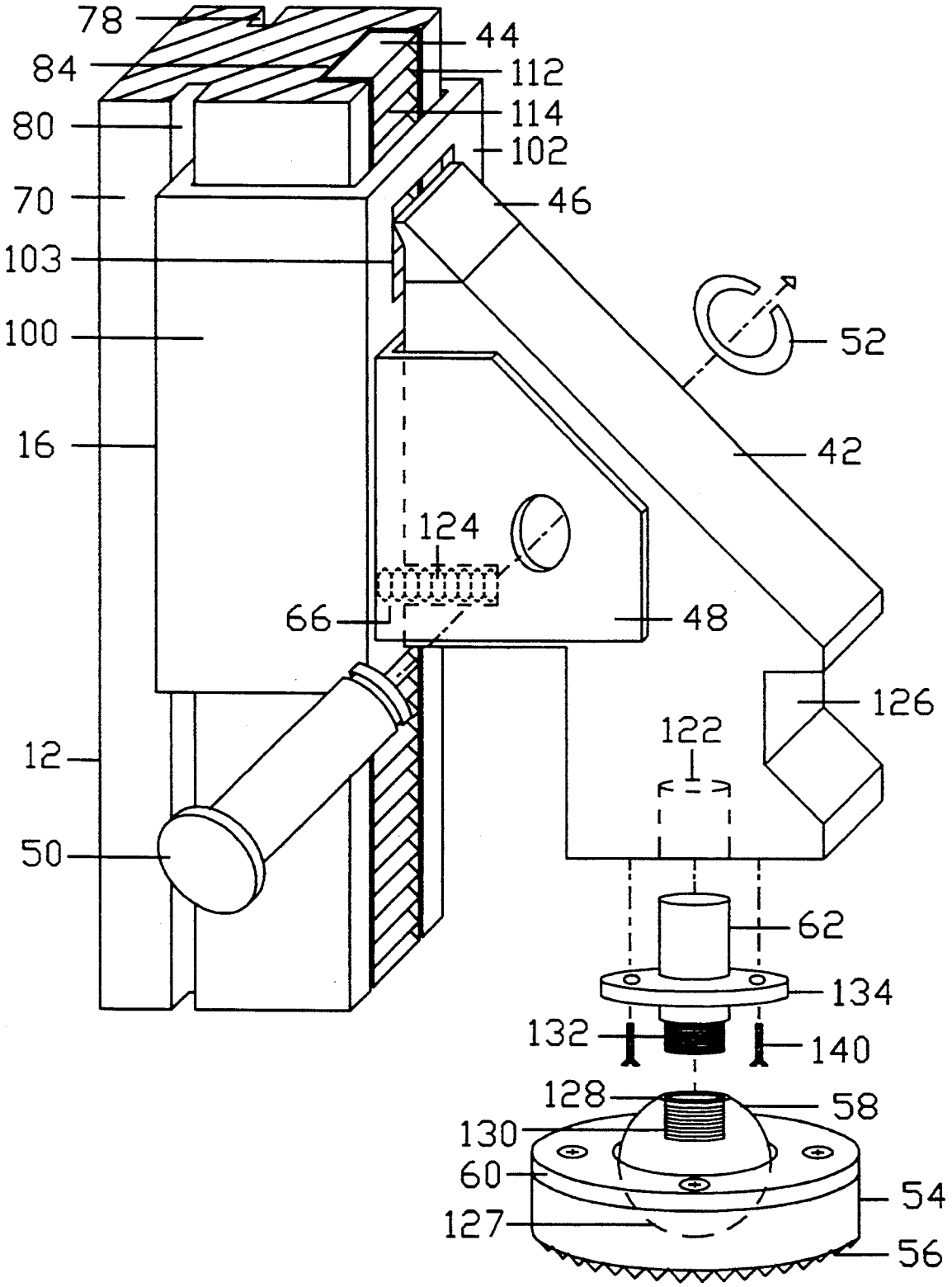

The lower carriage 16 includes a rear side surface 100, a face 102, a cut-out 103, and a pair of guide flanges 104 and 106 respectively; (FIGS. 1*b*, 3).

The lower carriage 16 is installed over the guide rail 12 by engaging the guide flanges 104 and 106 respectively, with the front and rear side lower grooves 78 and 80 respectively, of the guide rail 12; (FIG. 1*b*).

The brace latch 28 is attached to the guide rail 12; (FIG. 1).

The upper and lower end caps **18*a* and 18*b* respectively, each include a recess 136 and 138** respectively; (FIG. 1).

The upper end cap **18*a* is attached to the upper side of guide rail 12 so that the recess 136 engages the upper flange 88 of the guide rail 12**; (FIG. 1).

The lower end cap **18*b* is attached to the lower side of guide rail 12 so that the recess 138 engages the lower flange 90 of the guide rail 12**; (FIG. 1).

The incline indicator assembly 146 includes a tubular level vial 20, and a vial mount 22.

The level vial 20 is attached to the vial mount 22. (FIG. 1)

The assembly 146 is installed into the incline indicator recess 86 located in the face 68 of the guide rail 12; (FIG. 1).

The brace detention element 30 includes a sliding surface 108, and a resting surface 110; (FIG. 2).

The brace detention element 30 is attached to the guide rail 12 at the brace detention recess 82; (FIG. 2). The slope of the sliding surface 108 of the brace detention element 30 is pointed in a direction towards the lower side of the guide rail 12; (FIG. 2).

The brace stay mount 34 is attached to the rear side surface 92 of the upper carriage 14; (FIG. 2).

The brace stay 32 is attached to the brace stay mount 34 by means of the hinge pin 36. The hinge pin 36 is secured in place by the retaining ring 38; (FIG. 2).

The brace 26 is rotatably mounted to the face 94 of the upper carriage 14 by means of the flanged cylindrical element 24; (FIG. 2).

The foot detention element 44 includes a sliding surface 112, and a resting surface 114; (FIG. 3).

The foot detention element 44 is attached to the guide rail 12 at the foot detention recess 84; (FIGS. 1, 3). The slope of the sliding surface 112 of the foot detention element 44 is pointed in a direction towards the lower side of the guide rail 12; (FIG. 3).

The foot mount 48 is attached to the face 102 of the lower carriage 16; (FIG. 3).

The foot 42 includes a mounting post receptacle 122, a spring receptacle 124, and a notch 126; (FIG. 3).

The spring 66 is inserted into the spring receptacle 124 of the foot 42; (FIG. 3).

The foot 42 is attached to the foot mount 48 by means of the hinge pin 50. The hinge pin 50 is secured in place by the retaining ring 52; (FIG. 3).

The foot stay 46 is attached to the top of the foot 42, and is allowed to contact the foot detention element 44 through the cut-out 103 of the lower carriage 16; (FIG. 3).

The footpad 54 includes a concave recess 127 in its upper surface; (FIG. 3).

The friction element 56 is attached to the bottom of the footpad 54; (FIG. 3).

The ball end 58 includes a flat surface 128, and an internally tapped hole 130; (FIG. 3).

The ball end 58 rests in the concave recess 127, and the ball end retainer 60 is attached to the top of the footpad 54; (FIG. 3).

The mounting post 62 includes an externally threaded area 132, and a flange 134; (FIG. 3)

The mounting post 62 is attached to the ball end 58 by means of the threaded area 132 of the mounting post 62. The mounting post 62 is inserted into the mounting post receptacle 122 in the bottom of the foot 42 until the flange 134 contacts the bottom of the foot 42. The mounting post 62 is secured to the bottom of the foot 42 by a plurality of screws 140; (FIG. 3).

Figure 4:
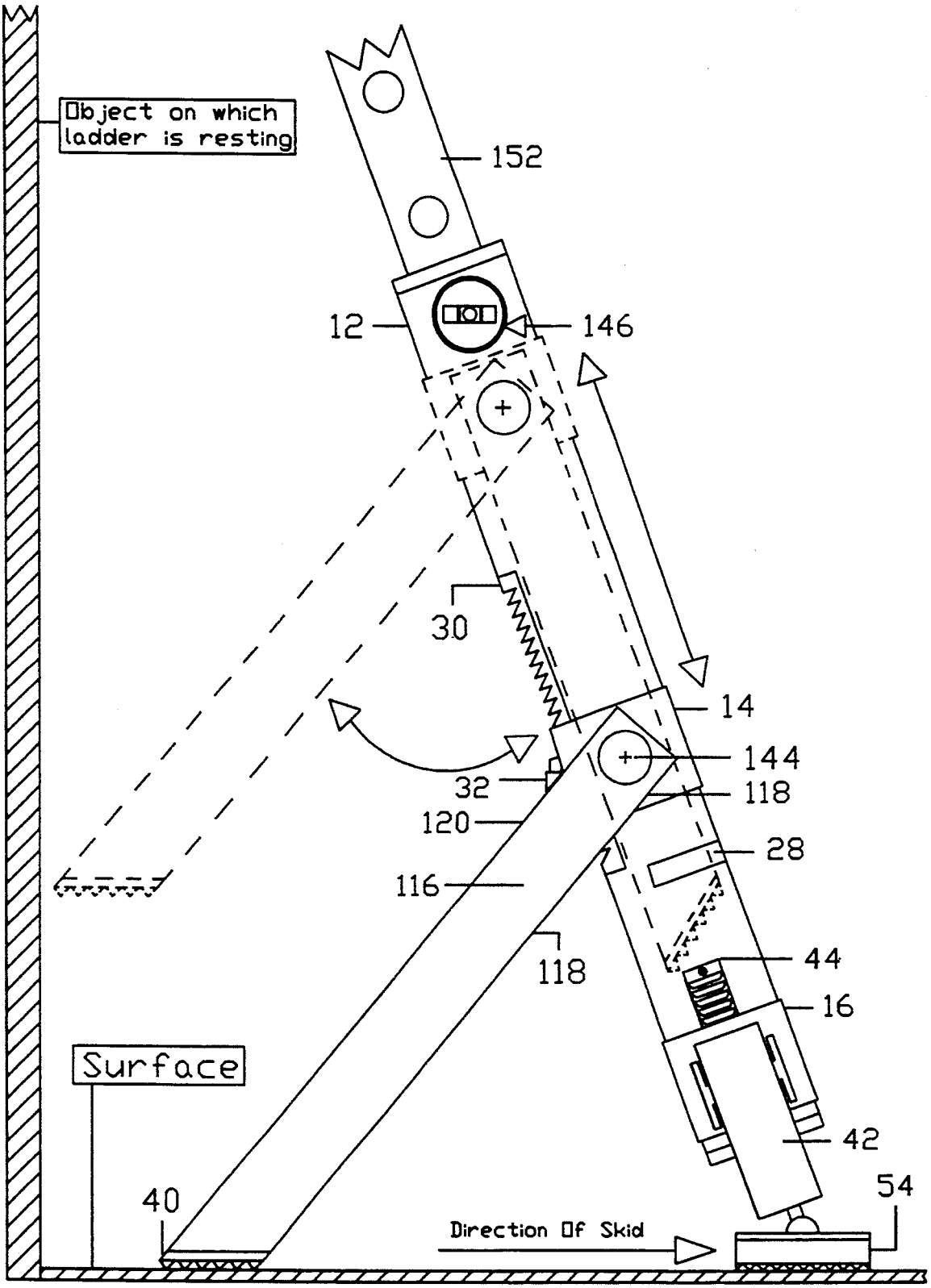

The brace 26 includes a face 116, a front side 118, and a rear side 120; (FIG. 4).

The friction element 40 is attached to the lower side of the brace 26; (FIG. 4).

Figure 5:
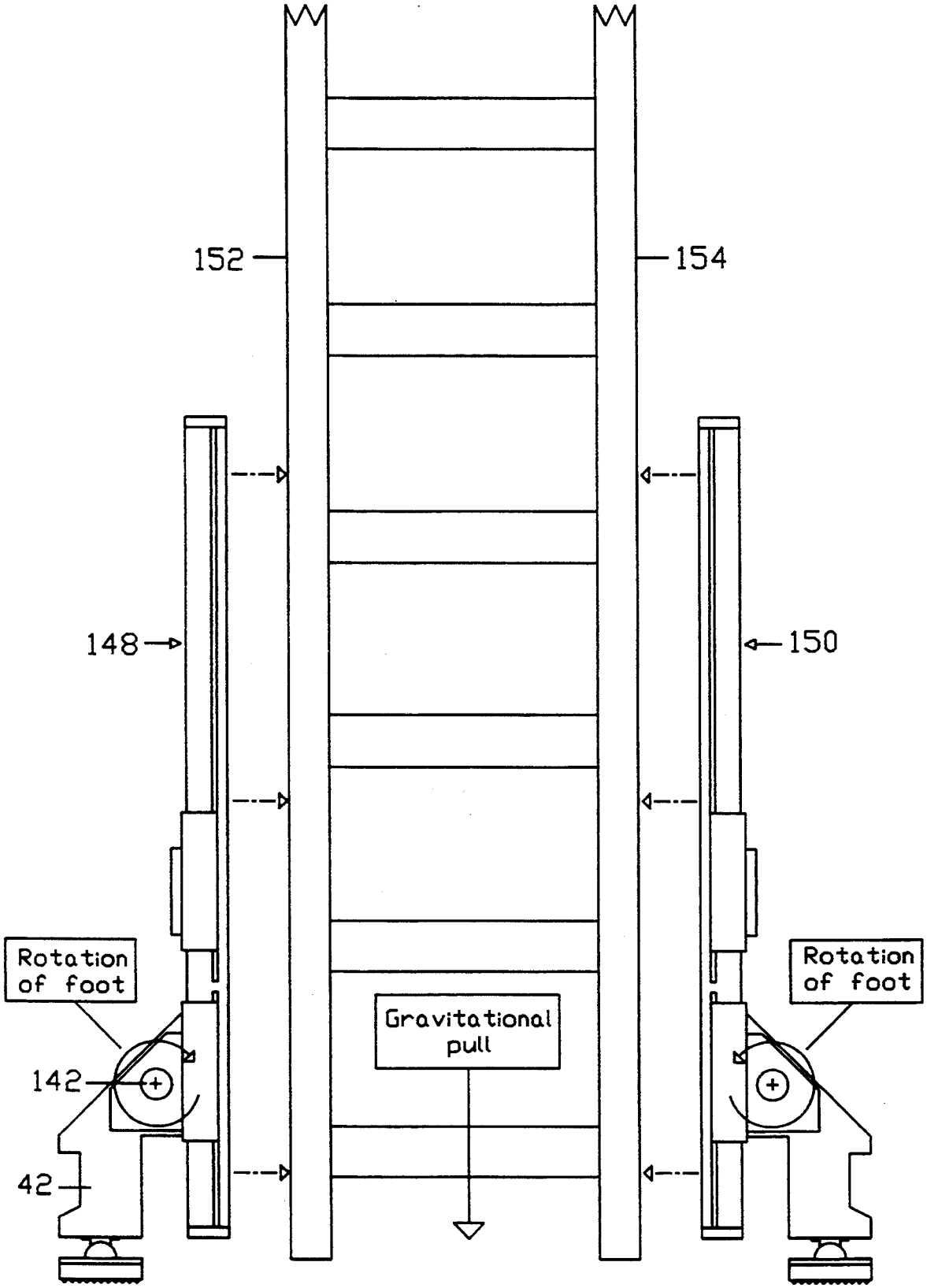

The complete invention comprising a pair of assemblies is shown in FIG. 5. The left assembly 148, is attached to the left side rail 152 of the ladder, and the right assembly 150, is attached to the fight side rail 154 of the ladder.

OPERATION

The ladder is rested against an object and adjusted for the proper incline angle by using the incline indicator 146. The optimum angle for safety has been achieved when the bubble in the level vial 20 is centered between the marks on the vial's surface as can be seen in FIG. 4. The user then determines the foot 42 which needs to be adjusted in order to level the ladder on uneven terrain. The notch 126 in the outer edge of the foot 42 provides a surface by which the user can insert his or her own foot so as to apply a simultaneous inward and downward pressure to the foot 42; (FIG. 3). The inward force causes the spring 66 to compress breaking the contact between the foot stay 46 and the resting surface 114 of the foot detention element 44. The downward force causes the lower carriage 16 to slide in a direction towards the lower side of the guide rail 12. Pressure is applied by the user until the friction element 56 of the footpad 54 contacts the surface. At this point, the user will remove his or her foot from the notch 126 thereby restoring the spring 66 to its uncompressed position. The pressure exerted by the spring 66 will cause the foot stay 46 to engage the resting surface 114 of the foot detention element 44. This will prevent the lower carriage 16 from sliding in a direction towards the upper side of the guide rail 12.

Upon contacting the surface, the ball end 58 will allow the footpad 54 to swivel in all directions, quickly adjusting to the slope of the terrain. The footpad 54 is round in shape and large in diameter to prevent it from sinking into soft terrain. The friction element 56, increases the grip between the footpad 54 and the surface on which it is resting; (FIG. 3).

As the user climbs the ladder, the pulling force of gravity on his body will cause the foot 42 to rotate about the hinge pin 50 at the pivot point 142; (FIG. 5). The resulting motion pushes the foot stay 46 against the foot detention element 44, thereby maintaining positive contact between the foot stay 46 and the foot detention element 44; (FIG. 3). Since the amount of force generated by the foot stay 46 against the foot detention element 44 is proportional to the pulling force of gravity on the user's body, the system as designed, will adjust the integrity of the contact between the foot stay 46 and the foot detention element 44 in relation to the weight of the user. The greater the weight of the user, the more force is generated to prevent the foot stay 46 from loosing contact with the foot detention element 44.

The foot 42 extends outward in a direction perpendicular to the face 102 of the lower carriage 16; (FIGS. 3, 5). This outrigger type foot 42, provides the ladder with a much wider footprint, thereby greatly increasing lateral stability.

The brace 26 is used to provide the ladder with anti-skid protection as illustrated in FIG. 4. In its stored position, the brace 26 is parallel to the guide rail 12, and the upper carriage 14 is at the upper limit of its travel. The brace 26 is held in the stowed position by the brace latch 28. The brace 26 is deployed by releasing the latch 28 and pulling the lower side of the brace 26 in a direction towards the object on which the ladder is resting. The brace 26 rotates about the flanged cylindrical element 24 at the pivot point 144, until a specified angle is achieved between the brace and the guide rail. Once the brace 26 has been fully extended, the upper carriage 14 is lowered until the friction element 40 of the brace 26 comes into contact with the surface; (FIG. 4).

The force of gravity always pulls an object downward in a straight line towards the center of the Earth. For this reason, contact between the footpad 54 and the surface on which it is resting is greatest when the user is positioned directly over the footpad 54. As the user climbs the ladder, the downward force of his or her weight moves away from the footpad, and is gradually transferred to the object on which the ladder is resting. If the remaining down force exerted on the footpad 54 is not sufficient to provide ample friction between the footpad 54 and the surface, the footpad 54 will begin to skid in a direction away from the object on which the ladder is resting; (FIG. 4).

The force of gravity on the user's body will provide the energy necessary to induce the skid. The motion of the skid is effectively stopped by transferring the energy of the skid from the footpad 54 to the brace 26. This is accomplished by the brace stay 32, which is responsible for locking the upper carriage 14 in a stationary position, as well as maintaining a constant angle between the brace 26 and the guide rail 12. During a skid, the ladder will begin to pivot about the flanged cylindrical element 24 at the pivot point 144; (FIG. 4). The brace stay 32 will use this pivoting action to wedge itself between the rear side 120 of the brace 26, and the brace detention element 30. The brace stay 32 contacts the brace detention element 30 by passing through the cut-out 95 in the rear side 92 of the upper carriage 14. As a result, the upper carriage 14 will be locked in a stationary position, and the angle established between the brace 26 and the guide rail 12 will be maintained. The forward motion of the skid is converted to downward pressure on the friction element 40 of the brace 26. The more the ladder tries to skid, the more downward pressure will be exerted on the friction element 40.

SUMMARY, RAMIFICATIONS, AND SCOPE

Accordingly, it can be seen that the anti-skid and leveling device of the present invention can be used to enable a ladder to resist skidding away from the object on which the ladder is resting, provide for the ability to level the ladder on uneven terrain, and provide the ladder with greater lateral stability. Furthermore the invention has the additional advantages in that;

1. Its construction is based on a guide rail to which all other elements are affixed, resulting in a compact, narrow structure only slightly wider than the side rails of the ladder itself, thus keeping the ladder slim and easy to handle.

2. It is permanently attached to the side rails of the ladder thereby allowing for ease of portability.

3. Since the guide rail's structural rigidity is enhanced by the side rails of the ladder, it can be made of a lightweight material such as plastic.

4. The sliding upper and lower carriages provide a sturdy yet simple means by which to adjust the invention's features.

5. The brace is hinged at the top and can be folded into a position parallel to the guide rail for efficient storage when not in use.

6. The height adjustment mechanism for the brace is self locking which eliminates any possibility of human error, while making adjustments to the brace quick and easy.

7. Since the brace remains parallel to the vertical plane of the ladder's side rail, it can be deployed in confined areas.

8. The foot is designed to act as an outrigger which adds to the lateral stability of the ladder.

9. The feet are independently adjustable in height enabling the ladder to be leveled on uneven terrain.

10. The height adjustment mechanism for the foot is self locking which eliminates any possibility of human error, while making adjustments to the invention's foot quick and easy.

11. The height of the invention's foot can be adjusted with pressure applied by the user's foot, enabling the user to keep both hands on the ladder.

12. The footpad is designed to swivel in all directions, enabling it to automatically adjust to the slope of the terrain.

13. The footpad is round in shape and large in diameter to help prevent it from sinking into soft terrain, as well as providing exceptional grip on harder surfaces.

14. The incline indicator provides the user with a quick, and accurate means for determining the proper incline angle of the ladder, which greatly affects its safety.

15. The device is self contained, requiring no other pans or assembly once installed.

16. The features of stability and levelability are effectively combined into a single device.

Although the above description includes many specificities, these should not be construed as limitations on the scope of the invention, but as merely providing an illustration of the preferred embodiment of this invention. For example:

1. The invention can be manufactured as an integral pan of the ladder.

2. The guide rail can be produced in two sections. The upper section would contain the anti-skid feature, while the lower section would contain the leveling feature. This allows the consumer greater flexibility at the time of purchase.

3. The feet can be fashioned so as to fold against the guide rail for more efficient storage.

Thus, the scope of the invention should be determined by the appended claims and their legal equivalents, rather than by the examples given.

I claim:

1. An anti skid and leveling device for ladders, comprising:

(a) a guide rail;

(b) an upper carriage affixed to said guide rail;

(c) a means for providing the free movement of said upper carriage along the longitudinal axis of said guide rail;

(d) a brace affixed to said upper carriage;

(e) a means for rotatably attaching said brace to said upper carriage;

(f) a means for automatically retaining said upper carriage in a stationary position at various points along the longitudinal axis of said guide rail;

(g) a lower carriage affixed to said guide rail;

(h) a means for providing the free movement of said lower carriage along the longitudinal axis of said guide rail;

(i) a means for automatically retaining said lower carriage in a stationary position at various points along the longitudinal axis of said guide rail;

(j) a foot attached to said lower carriage;

(k) a means for attaching said foot to said lower carriage;

(l) a footpad attached to said foot;

(m) a means for swiveling said footpad;

(n) a means for attaching said footpad to said foot;

(o) a means for setting the optimum incline angle of said ladder:

2. An anti skid and leveling device as described in claim 1, wherein said guide rail contains a longitudinal upper grove in each side.

3. An anti skid and leveling device as described in claim 2, wherein flanges on said upper carriage will engage said upper groves providing guidance over the travel distance of said upper carriage.

4. An anti skid and leveling device as described in claim 3, wherein a flanged cylindrical element is used to rotatably attach said brace to said upper carriage.

5. An anti skid and leveling device as described in claim 4, wherein a brace stay is attached to said upper carriage.

6. An anti skid and leveling device as described in claim 5, wherein a brace detention element is attached to said guide rail.

7. An anti skid and leveling device as described in claim 6, wherein said guide rail contains a longitudinal lower grove in each side.

8. An anti skid and leveling device as described in claim 7, wherein flanges on said lower carriage will engage said lower groves providing guidance over the travel distance of said lower carriage.

9. An anti skid and leveling device as described in claim 8, wherein a foot mount is attached to said lower carriage.

10. An anti skid and leveling device as described in claim 9, wherein a foot is attached to said foot mount.

11. An anti skid and leveling device as described in claim 10, wherein a foot stay is attached to said foot.

12. An anti skid and leveling device as described in claim 11, wherein a foot detention element is attached to said guide rail.

13. An anti skid and leveling device as described in claim 12, wherein a mounting post is attached to said foot.

14. An anti skid and leveling device as described in claim 13, wherein a footpad is attached to said mounting post.

15. An anti skid and leveling device as described in claim 14, wherein a level vial is attached to the guide rail.

* * * * *